US006972278B2

(12) United States Patent
Hsu et al.

(10) Patent No.: US 6,972,278 B2
(45) **Date of Patent: *Dec. 6, 2005**

(54) LAUNDRY DETERGENT GEL WITH SUSPENDED PARTICLES

(75) Inventors: Feng-Lung Gordon Hsu, Tenafly, NJ (US); Yun Peng Zhu, Fairlawn, NJ (US); John David Hines, Wirral (GB); Ronald Frederick Vogel, New York, NY (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/772,824

(22) Filed: Feb. 5, 2004

(65) Prior Publication Data

US 2005/0176610 A1 Aug. 11, 2005

(51) Int. Cl.[7] ..... C11D 17/00
(52) U.S. Cl. ..... 510/280; 510/277; 510/336; 510/351; 510/403; 510/424; 510/426; 510/491
(58) Field of Search ..... 510/280, 277, 510/283, 336, 351, 403, 424, 426, 491

(56) References Cited

U.S. PATENT DOCUMENTS

| | | | | |
|---|---|---|---|---|
| 4,515,704 | A | 5/1985 | Akred et al. | 252/135 |
| 4,749,512 | A | 6/1988 | Broze et al. | 252/174.18 |
| 4,801,395 | A | 1/1989 | Chazard et al. | 252/99 |
| 4,900,469 | A | 2/1990 | Farr et al. | 252/96 |
| 5,147,576 | A | 9/1992 | Montague et al. | 252/174 |
| 5,281,355 | A | 1/1994 | Tsaur et al. | 252/174.13 |
| 5,281,356 | A | 1/1994 | Tsaur et al. | 252/174.13 |
| 5,538,662 | A | 7/1996 | Klier et al. | 252/122 |
| 5,562,939 | A | 10/1996 | Lewis | 426/250 |
| 5,597,790 | A | 1/1997 | Thoen | 510/303 |
| 5,820,695 | A | 10/1998 | Lance-Gomez et al. | 134/42 |
| 5,952,285 | A | 9/1999 | Hawkins | 510/405 |
| 5,952,286 | A | 9/1999 | Puvvada et al. | 510/417 |
| 5,972,869 | A | 10/1999 | Cao et al. | 510/292 |
| 6,001,795 | A | 12/1999 | Charlez et al. | 510/365 |
| 6,077,816 | A | 6/2000 | Puvvada et al. | 510/406 |
| 6,362,156 | B1 | 3/2002 | Hsu et al. | 510/418 |
| 6,399,563 | B1 | 6/2002 | Durbut et al. | 510/413 |
| 2003/0171231 | A1 | 9/2003 | Shana'a et al. | 510/130 |

FOREIGN PATENT DOCUMENTS

| | | |
|---|---|---|
| EP | 832 964 | 4/1998 |
| GB | 1 303 810 | 1/1973 |
| GB | 2 351 979 A | 1/2001 |
| GB | 2 355 015 | 4/2001 |
| WO | 97/26315 | 7/1997 |
| WO | 99/06519 | 2/1999 |
| WO | 99/27065 | 6/1999 |
| WO | 03/060050 A1 | 7/2003 |

OTHER PUBLICATIONS

International Search Report, Application No. PCT/EP 03/09012 dated Aug. 13, 2003, 4 pages.
International Search Report, Application No. PCT/EP 03/09386 dated Aug. 22, 2003, 6 pages.
International Search Report, Application No. PCT/EP 03/08952 dated Aug. 13, 2003, 6 pages
Co-pending Application: Applicant: Hsu et al., U.S. Appl. No.: 10/251,738; filed: Sep. 20, 2002.
Co-pending Application: Applicant: Hsu et al., U.S. Appl. No.: 10/251,481; filed: Sep. 20, 2002.
Co-pending Application: Applicant: Hsu et al., U.S. Appl. No.: 10/251,458; filed: Sep. 20, 2002.
Co-pending Application: Applicant: Hsu et al., U.S. Appl. No.: 10/247,957; filed: Sep. 20, 2002.
Co-pending Application: Applicant: Hsu et al., U.S. Appl. No.: 10/694,980; filed: Oct. 28, 2003.
Co-pending Application: Applicant:: Hines et al., U.S. Appl. No.: 10/702,231; filed: Nov. 6, 2003.
PCT International Search Report in a PCT application PCT /EP 03/09385.

*Primary Examiner*—Necholus Ogden
(74) *Attorney, Agent, or Firm*—Rimma Mitelman

(57) ABSTRACT

A shear-thinning lamellar gel detergent composition containing suspended particles, employing a non-neutralized fatty acid as a structuring agent, in a specific amount, depending on the total surfactant level. The weight % ratio of non-neutralized fatty acid to the total surfactant within a specific range, defined by the Gelling Index equation, results in gels with the desired properties. The inventive product offers an advantage of laundry pre-treater and a detergent in a single product and also provides a visual cue of suspended particles.

15 Claims, No Drawings

LAUNDRY DETERGENT GEL WITH SUSPENDED PARTICLES

FIELD OF THE INVENTION

The invention relates to laundry detergent gel with suspended particles.

BACKGROUND OF THE INVENTION

For a variety of reasons, it is often greatly desirable to suspend particles in detergent compositions. For example, because there are certain components (e.g., bleaches, enzymes, perfumes) which readily degrade in the hostile environment of surfactant containing heavy duty liquids, these components can be protected in capsule particles (such as described, for example, in U.S. Pat. Nos. 5,281,355 and 5,281,356 to Tsaur et al., hereby incorporated by reference into the subject application) and the capsule particles may be suspended in the liquid detergents. Other particles which may be suspended include enzymes (whether or not encapsulated) and desirable ingredients (e.g., polyvinylpyrrolidone, aminosilicones, soil release agents, antiredepositon agents, antiwrinkle agents, etc.)

Liquid compositions with suspended particles have been described. See for instance U.S. Pat. No. 5,147,576 to Montague et al.; U.S. Pat. No. 4,749,512 to Broze et al., U.S. Pat. No. 5,562,939 to Lewis; U.S. Pat. No. 5,597,790 to Thoen; GB 1,303,810 and U.S. Pat. No. 6,362,156 to Hsu et al. Some of the problems with the previously described compositions are that they hard to pour (too thick), and/or use expensive, non-functional ingredients (e.g., xanthan gum).

Thickened or gel laundry products are preferred by many consumers, over either powder or liquid detergents. Gels provide the advantages of liquid detergents, but also can be used for pretreatment of fabrics, obviating the necessity for purchase of a separate pre-treatment product.

Gel detergents have been described. See, for instance, WO 99/06519 and WO 99/27065, Klier et al. (U.S. Pat. No. 5,538,662), GB 2 355 015, Lance-Gomez et al. (U.S. Pat. No. 5,820,695), Hawkins (U.S. Pat. No. 5,952,285), Akred et al. (U.S. Pat. No. 4,515,704), Farr et al. (U.S. Pat. No. 4,900,469).

Typically, the gelling and/or thickening is accomplished by one or more of the same approaches as used in suspending particles, i.e.: high solids concentration, high surfactant concentration, high soap concentration, use of special thickening agents (such as polymers or gums). Such approaches are problematic: special thickening actives and/or high active concentrations are not cost-effective, high solids may impede product appearance and functionality.

The need remains for improved gel detergent compositions which have desirable properties for use and dosing, yet are able to stably suspend relatively large particles, and it is especially desirable to achieve these goals through the use of agents that deliver laundry cleaning performance benefits (e.g., fatty acids).

Although fatty acids have been mentioned, they are mentioned as surfactants (i.e. neutralized to soaps), or, in any event, used in fully neutralized form and exemplified in fully neutralized compositions. Thus, although prior disclosures may mention "fatty acids," it is specifically non-neutralized fatty acids and their amount vis-à-vis the total surfactant that are employed in the present invention, in order to obtain gels with the desired properties, that can also suspend relatively large particles.

SUMMARY OF THE INVENTION

The present invention includes a gel laundry detergent and/or pre-treater composition comprising:

(a) from about 8% to about 35%, by weight of the composition, of a surfactant, A, selected from the group consisting of anionic, nonionic and cationic, and amphoteric surfactants and mixtures thereof;

(b) from about 0.1% to about 5%, by weight of the composition of a non-neutralized fatty acid, a fatty alcohol, and mixtures thereof;

(c) from about 50% to about 90% of water;

(d) from about 0.1% to about 10%, by weight of the composition of suspended particles having a size from about 300 to about 5000 microns;

(e) wherein the weight % ratio of the non-neutralized fatty acid to the surfactant is less than about 1 but greater than or equal to the Gelling Index Value, G, defined by equation (I)

$$G = \frac{0.75}{1 + (0.11 \times A)^{8.3}} - (0.0062 \times A - 0.25). \quad \text{(I)}$$

The preferred inventive compositions are gels with the Yield Stress in the range from 0.01 Pa to 10 kPa, in order to suspend the particles, yet to maintain the desired Pouring Viscosity.

Surprisingly, it has been discovered, as part of the present invention, that by employing non-neutralized fatty acid as a gelling agent in a specific ratio to total surfactant, a shear-thinning, lamellar gel can be attained, with the desired pouring viscosity (e.g., not too thick to pour) and which are also able to suspend particles (have the desired yield stress).

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the gel detergent composition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Gel" as used herein means a shear thinning, lamellar gel, with a pouring viscosity in the range of from 100 to 5,000 mPas (milli Pascal seconds), more preferably less than 3,000 mPas, most preferably less than 1,500 mPas. The concept of "gel" in the art is frequently not well defined. The most common, loose definition, however, is that a gel is a thick liquid. Nevertheless, a thick liquid may be a Newtonian fluid, which does not change its viscosity with the change in flow condition, such as honey or syrup. This type of thick liquid is very difficult and messy to dispense. A different type of liquid gel is shear-thinning, i.e. it is thick at low shear condition (e.g., at rest) and thin at high flow rate condition.

The rheology of shear-thinning gel may be characterized by Sisko model:

$$\eta = a + b \times \dot{\gamma}^{n-1}.$$

Where $\eta$ is Viscosity, mPA s, $\dot{\gamma}$ is shear rate, 1/sec, a, b are constants, and n is Sisko Rate index.

As used herein, "Shear-thining" means a gel with the Sisco rate index less than 0.6.

Shear-thinning Theological property can be measured by a viscometer or a sophisticated rheometer. Select a spindle for the measurement. Generally, cylindrical spindle needs more sample, less sample is needed for both disc or cone shape spindle. The selection of spindle also depends on the type of instrument. It involves the procedure of steady state flow (SSF). The first step is conditioning step to condition the sample by pre-shearing the sample at a set temperature, say at 25° C. The time requirement depends on the type of sample. In general, it takes from 30 seconds to an hour. The second step is the steady state flow step. It involves adjusting either shear stress (for control stress rheometer only) or shear rate for collecting reliable data. In some cases, as much as 5 minutes must be allowed for the reading to reach apparent equilibrium. Usually, one can just wait until the reading appears relatively constant for a reasonable time. To determine the flow behavior, the maximum shear rate and the ramp time can be arbitarily chosen for the test program. During the test, up to 1000 data points are gathered and the viscosity, shear stress, shear rate, temperature and test time of a point are stored. The plot of viscosity vs. shear rate will reveal whether the sample is shear thinning or not. A mathematical model, such as Sisko model, may be fitted to the data points.

As used herein, "pouring viscosity" means viscosity measured at a shear rate of 21 $s^{-1}$, which can be measured using the procedure described immediately above, or it can be read off the plot of viscosity vs. shear rate.

The Yield Stress, $\tau_y$, of a gel determines its particle suspending capability. The direct measurement of yield stress may be carried out by the Vane method as described by Dzuy, N. Q. and Boger, D. V. in Journal of Rheology, 1985. A four-bladed vane used in the measurement immersed in a sample is rotated slowly at a constant rate to detect the yielding moment when the torque exerted on the vane shaft reaches a maximum value. The presence of such a maximum in the torque response is a characteristic of yield stress materials, which can be explained by the concept of structural deformation and breaking of bonds in flocculated systems. The yield stress can then be derived from the maximum torque and the geometry of the vane.

If $$\tau_y A_p \geqq (\rho_p - \rho_g) g V_p$$

where $A_p$ is the surface area of a particle, $\rho_p$ is the density of particle, $\rho_g$ is the density of gel, g is the gravitational acceleration, $V_p$ is the volume of a particle), then the particle is suspended in the gel. Generally the Yield Stress in the inventive compositions is greater than 0.01 Pa, preferably greater than 0.5 Pa, most preferably greater than 10 Pa generally.

On the other hand, if the Yield Stress is too high, then the fluid may not flow until additional force is exerted. In general, the Yield Stress for the inventive gels is less than 10 KPa, preferably less than 5 kPa and most preferably less than 1 kPa.

As used herein, "lamellar" means that liquid crystals within the gel have lipid layers (sheets). Lamellar structures can be detected by polarized light microscope. Furthermore, majority of these lamellar sheets remain in a sheet form and only a very limited portion, say less than 10% of lamellar phase, is rolled up to form onion structure—like of vesicles. As used herein, "lamellar gels" means gels that have lamellar phase structure, alone, in intermixed with isotropic phase (known as L1).

"Transparent" as used herein includes both transparent and translucent and means that a physical object (e.g., a hand or a piece of paper) is visible when viewed (without the help of any instruments or tools other than eyeglasses and under normal daylight conditions) through a 1-cm cuvette filled with the inventive composition.

"Particle" as used herein means non-soluble or low solubility ingredients or various capsules or insoluble liquid droplets. Preferably, the shape of particles is spherical or at least it is isometric. But other shapes are also acceptable, especially for extruded particles with special design shape, such as alphabets, star or animal shapes. The size of particles is about 300 to 5000 $\mu$m, preferably from 500 to 2500 $\mu$m and most preferably from 700 to 2000 $\mu$m.

Particle Size Analysis

Particle size analysis for solid particles may be performed using U.S. Standard Size designated test sieves Number 4 through Number 400. This corresponds to particle size diameters of 4705 micron (Number 4) through 38 micron (Number 400). W. S. Tyler Ro-Tap—was used for sieve size analysis. The weights of particles left in each sieve were measured and used for the calculation of the mean particle size distribution. Liqht scattering particle size measurement is suitable for liquid particles or droplets measurement. Malvern Mastersizer E may be used for either solid particles or liquid particle measurement.

Detergent Surfactant

The compositions of the invention contain one or more surface active agents selected from the group consisting of anionic, nonionic, cationic, amphoteric and zwitterionic surfactants or mixtures thereof. The preferred surfactant detergents for use in the present invention are mixtures of anionic and nonionic surfactants although it is to be understood that anionic surfactant may be used alone or in combination with any other surfactant or surfactants. Detergent surfactants are typically oil-in-water emulsifiers having an HLB above 8, typically 12 and above. Detergent surfactants are included in the present invention for both the detergency and to create an emulsion with a continuous aqueous phase.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) water soluble higher alkyl aryl sulfonates, alkyl sulfonates, alkyl sulfates and the alkyl poly ether sulfates.

Anionic surfactants may, and preferably do, also include fatty acid soaps—i.e., fully neutralized fatty acids.

One of the preferred groups of anionic surface active agents are the alkali metal, ammonium or alkanolamine salts of higher alkyl aryl sulfonates and alkali metal, ammonium or alkanolamine salts of higher alkyl sulfates. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates. Also normal alkyl and branched chain alkyl sulfates (e.g., primary alkyl sulfates) may be used as the anionic component.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R_1—O(CH_2CH_2O)_p—SO_3M,$$

where $R_1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

It should be noted that linear ethoxy sulfates (LES) acid is not stable. Accordingly, when LES is employed, it is pre-neutralized and used as 70% active paste, without hydrotrope, and is diluted during the processing.

The detergent compositions of the present invention are laundry compositions and consequently, preferably include at least 2% of an anionic surfactant, to provide detergency and foaming. Generally, the amount of the anionic surfactant is in the range of from 3% to 35%, preferably from 5% to 30% to accommodate the co-inclusion of nonionic surfactants, more preferably from 6% to 20% and, optimally, from 8% to 18%.

The anionic surfactant may be, and preferably is, produced (neutralized) in situ, to minimize processing cost, by neutralization of the precursor anionic acid (e,g. linear alkylbenzene sulfonic acid and/or fatty acid) with a base. Suitable bases include, but are not limited to monoethanolamine, triethanolamine, alkaline metal base, and preferably is sodium hydroxide and monoethanalamine mixture, because sodium hydroxide is the most economic base source and monoethanolamine offers better pH control.

Nonionic Surfactant

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature).

Usually, the nonionic surfactants are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 5 to 20. Of such materials it is preferred to employ those wherein the alkanol is a fatty alcohol of 9 to 11 or 12 to 15 carbon atoms and which contain from 5 to 8 or 5 to 9 alkoxy groups per mole. Also preferred is paraffin—based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodol® trademark: Dobanol® 91-5 is an ethoxylated $C_9$–$C_{11}$ fatty alcohol with an average of 5 moles ethylene oxide and Dobanol® 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols or alyl phenols with relatively narrow contents of ethylene oxide in the range of from about 6 to 11 moles, and the $C_9$ to $C_{11}$ fatty alcohols ethoxylated with about 5-6 moles ethylene oxide.

Another class of nonionic surfactants which can be used in accordance with this invention are glycoside surfactants.

Generally, nonionics would comprise 0-32% by wt., preferably 5 to 30%, more preferably 5 to 25% by wt. of the composition.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Amphoteric synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino)octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)$_2$-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The total amount of surfactant used may vary from 8 to 35%, preferably 10 to 30%, more preferably 12 to 25%.

As noted, the preferred surfactant systems of the invention are mixtures of anionic and nonionic surfactants.

Particularly preferred systems include, for example, mixtures of linear alkyl aryl sulfonates (LAS) and alkoxylated (e.g., ethoxylated) sulfates (LES) with alkoxylated nonionics for example in the ratio of 1:2:1 or 2:1:1.

Preferably, the nonionic should comprise, as a percentage of an anionic/nonionic system, at least 20%, more preferably at least 25%, up to about 75% of the total surfactant system. A particularly preferred surfactant system comprises anionic:nonionic in a ratio of 3:1 to 1:3.

Non-Neutralized Fatty Acid

Non-neutralized fatty acids are employed in the present invention as gelling or structuring agents. Their use is advantageous compared to the use of gums and polymers, since they are able to provide structuring for suspension of particles, combined with other advantages, e.g. pouring ease, while also providing laundry cleaning functional benefits, e.g. non-neutralized fatty acid also can be neutralized by a pH-jump system after the dilution during wash or can be used as a builder.

Conventional (polymeric and other) structuring agents may be included, although preferred compositions are substantially free of such conventional structuring agents, to minimize the cost of compositions and to improve stability, Preferred inventive compositions contain at most 0.5%, preferably less than 0.25%, most preferably less than 0.1, and optimally from 0 to 0.05% of conventional structuring agents.

"Conventional structuring agents" as used herein include but are not limited to cross-linked polyacrylates, polysaccaride gums such as xanthan, gellan, pectin, carrageenan, gelatin, clay, fine silica, and cellulose derivatives.

Any fatty acid is suitable, including but not limited to lauric, myristic, palmitic stearic, oleic, linoleic, linolenic acid, and mixtures thereof, preferably selected from fatty acid which would not form crispy solid at room temperature. Naturally obtainable fatty acids, which are usually complex mixtures, are also suitable (such as tallow, coconut, and palm kernel fatty acids). The preferred fatty acid is oleic acid because it is liquid at room temperature and its C18—chain helps to induce lamellar phase. Furthermore, it is also a builder and after neutralization, it can offer good detergency.

For the avoidance of doubt, the following pKa values were employed in the present invention to calculate the amount of non-neutralized fatty acid in the compositions:

Table of pKa Value of Fatty acids*

| Fatty acid chain length | Measured pKa value |
|---|---|
| 8 | 6.3~6.5 |
| 10 | 7.1~7.3 |
| 12 | ~7.5 |
| 14 | 8.1~8.2 |
| 16 | 8.6~8.8 |
| 16** | 8.5 |

*Cited from Langmuir, Vol 16, pp 172–177, 2000 (J. R. Kanicky, A. F. Poniatowski, N. R. Mehta, and D. O. Shah);
**Proc. R. Soc. London, A133, 140, 1931 (R. A. Peters).

Indsutrial grade Coco acid is a mixture of fatty acids containing C8 acid to C18 fatty acids. Also industrial grade Oleic acid is a mixture of fatty acids having C14 acid to C18 fatty acid. The difference in alkyl chain length in such a mixture of fatty acids can weaken the Van der Waals interaction between fatty acid molecules, and this results in an reduction in pKa value as compared with the pure fatty acid.

The amount of the non-neutralized fatty acid depends on the amount of surfactant employed. Generally, the amount of the structuring agent is in the range of from 0.1% to 5%, preferably from 0.2% to 4%, more preferably from 0.5 to 3%, to obtain optimum gels at minimum cost.

Ratio of Non-Neutralized Fatty Acid to the Surfactant

Weight % ratio of the non-neutralized fatty acid to the total surfactant, A, is less than 1, but greater than or equal to the Gelling Index Value, G, defined by equation (I):

$$G = \frac{0.75}{1 + (0.11 \times A)^{8.3}} - (0.0062 \times A - 0.25) \quad \text{(I)}$$

The total surfactant does not include the amount of non-neutralized anionic surfactant precursors, but does include fully neutralized fatty acid soap surfactant.

If the ratio is greater than 1, the surfactant system may not solubilize all non-neutralized fatty acid and phase separation results. If the ratio is less than the Gelling Index Value, G, the gel does not form.

pH pH of the inventive compositions is generally in the range of from 6 to 8, preferably from 6.2 to 7.8, more preferably from 6.5 to 7.5, most preferably from 6.8 to 7.4.

Water

The inventive compositions generally include water as a solvent and the carrier. Water amount is preferably in the range of from 50 to 90%, more preferably from 55 to 85%, most preferably from 60 to 80%.

Particles and Capsulates

The suitable particles or capsulates are 300 micron to 5000 microns in size, and preferably 500 to 3000 microns, most preferably 700 to 2000 microns in size. When the size is too small, e.g. less than 300 microns, the final product appears to be opaque. On the other hand, the consumers think particles would not be dissolved for size greater than 5000 microns. The density should be in the range of 0.8 to 3 g/cm$^3$, preferably in the range of 0.9 to 1.8 g/cm$^3$, and most preferably in the range of 0.95 to 1.20 g/cm$^3$.

The particles and encapsulates may be either hydrophobic or hydrophilic in nature due to its application and the shell materials. There are many capsule suppliers, such as: 3M, Lipo, Kobo, Aveka, and others. Some granules may be also used as a suspending particles.

Technically, it is well known in the art that detergents provide a hostile environment for desirable ingredients such as, for example, bleaches, enzymes and perfumes. Components which are sensitive to the ingredients found in the compositions (e.g., enzymes in detergent compositions, particularly concentrated detergent compositions, are denatured by surfactants in the detergent composition) can be encapsulated and protected until they are ready for release. Some types of encapsulated enzyme capsules are disclosed in U.S. Pat. No. 5,281,355 to Tsaur et al. and U.S. Pat. No. 5,589,370 to Ratuiste et al. Commercial enzyme granules originally designed for powder detergent, such as Purafect 3100G, can also be used in this application.

Components which are simply more desirably released later in the wash (e.g., perfumes, fabric softening agents or anti-foams) can be encapsulated and controllably released, for example, by dilution of a concentrated liquid.

Other components, such as anti-redeposition agent CP-5 polymer or builder zeolite are not soluble in isotropic heavy duty liquid detergent compositions. These fine, insoluble particles cause the opaqueness of products. To prevent the opaqueness, these fine particle components can be pre-granulated and post dosed as suspended particles.

Liquid components that are immiscible with liquid detergent compositions, such as amino silicone and silicone defoamer can be incorporated as encapsulates. Functional polymers including color protecting polymers, fabric protection polymers and soil release polymers, such as PVP (polyvinylpyrrolidone), Narlex DC-1 ex National Starch (e.g., polyacrylate copolymer) and that can be salted out due to the high electrolyte concentration in liquid detergent compositions also can be incorporated in an encapsulated form.

In particular, it is desirable to encapsulate one or more enzymes since enzymes are highly efficient laundry washing ingredients used to promote removal of soils and stains during the cleaning process. Furthermore, it is also desirable to encapsulate bleach and enzymes separately to further enhance detergent efficacies.

Stability

The inventive compositions can suspend 300 to 5,000 micron particles for at least 2 weeks preferably at least 3 weeks, most preferably at least 5 weeks at room temperature.

Optional Ingredients

A particularly preferred optional ingredient(s) is a pH jump system (e.g., boron compound/polyol), as described in the U.S. Pat. Nos. 5,089,163 and 4,959,179 to Aronson et al., incorporated by reference herein. The inclusion of the pH jump system ensures that the pH jumps up in the washing machine to neutralize fatty acid, so as to obtain the benefits of neutralized fatty acid and to minimize surfactant amount.

Anti-Oxidant

A particularly preferred optional ingredient is an anti-oxidant. It has been found that the use of an anti-oxidant in conjunction with non-neutralized fatty acid, especially unsaturated fatty acid, e.g. Oleic acid, may prevent or substantially minimize the discoloration or yellowing of a gel. Suitable anti-oxidants include but are not limited to butylated hydroxytoluene (BHT), TBHQ (tert-butylhydroquinone), propyl gallate, gallic acid, Vitamin C, Vitamin E, Tannic acid, Tinogard, Tocopherol, Trolox, BHA (butylated hydroxyanisole), and other known-anti-oxidant compounds. BHT is preferred. Generally, from 0.0% to about 5.0%, preferably from 0.01% to 1%, more preferably from 0.05% to 0.5% may be employed.

Hydrotrope

Hydrotrope reduces and prevents liquid crystal formation. Generally, it is known that the addition of hydrotrope destroys gels. Surprisingly, it has been discovered that the addition of a low level of hydrotrope aids in the formation of inventive gels, while also improving the clarity/transparency of the composition. Suitable hydrotropes include but are not limited to propylene glycol, glycerine, ethanol, urea, salts of benzene sulphonate, toluene sulphonate, xylene sulphonate or cumene sulphonate. Suitable salts include but are not limited to sodium, potassium, ammonium, monoethanolamine, triethanolamine. Preferably, the hydrotrope is selected from the group consisting of propylene glycol, glyurine xylene sulfonate, ethanol, and urea to provide optimum performance. The amount of the hydrotrope is generally in the range of from 0 to 6%, preferably from 0.1 to 5%, more preferably from 0.2 to 4%, most preferably from 0.5 to 3%. The most preferred hydrotrope is propylene glycol and/or glycerine because of their ability, at a low level, to improve gel quality without destroying the structure.

Colorant

The colorant may be a dye or a pigment. Most preferably, a water-soluble dye (to prevent staining on clothes) is employed. The preferred compositions are blue.

Builders/Electrolytes

Non-neutralized fatty acid, especially unsaturated fatty acid, may also function as a builder.

Additional builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts. Most preferred electrolyte is borax, because it can be used in a complex form with polyol, which reserves an alkaline source until the composition is diluted. Thus, it neutralizes non-neutralized fatty acid, upon dilution in the washing machine. The level of borax is preferably from 0% to 15%, preferably 0.5 to 10%, more preferably 1 to 8%.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, (e.g. from 0 to 15%, preferably from 1 to 10%).

Certain zeolites or aluminosilicates can be used. One such aluminosilicate which is useful in the compositions of the invention is an amorphous water-insoluble hydrated compound of the formula $Na_x[(AlO_2)_y.SiO_2]$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

The preferred laundry composition may further include one or more well-known laundry ingredients, anti-redeposition agents, fluorescent dyes, perfumes, soil-release polymers, colorant, enzymes, enzyme stabilzation agents (e.g., sorbitol and/or borates), buffering agents, antifoam agents, UV-absorbers, etc.

Optical brighteners for cotton, polyamide and polyester fabrics can be used. Suitable optical brighteners include Tinopal, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

Use of the Composition

The compositions are used as laundry cleaning products (e.g., a laundry detergent, and/or a laundry pretreater). The inventive product offers an advantage of laundry pre-treater and a detergent in a single product. In use, a measured amount of the composition is deposited on the laundry or in the laundry washing machine, whereupon mixing with water, the cleaning of laundry is effected. It should be noted that due to the presence of non-neutralised fatty acid in the compositions, the compositions are low foaming and are particularly suitable for the use in front-loading laundry machines.

Process of Making Composition

The composition may be prepared by mixing the ingredients by any suitable method known in the art. According to the preferred method of making the compositions, the pre-mix containing all the ingredients, except non-neutralized fatty acid is prepared. The acid is added in the last step. The preferred method delays the gelling of the composition till the last step, thus simplifying manufacturing and ensuring the best mixing of the ingredients. Most preferably, the non-neutralised fatty acid and nonionic surfactant (used for solubilising the fatty acid) are mixed and added last, to the main mix containing the rest of the ingredients, the latter comprising an anionic surfactant. If antioxidant is included in formula, it is preferred added either with perfume or the premix of nonionic and fatty acid.

Container

The inventive compositions are opaque or transparent, and are preferably packaged within the transparent/translucent bottles.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

The following specific examples further illustrate the invention, but the invention is not limited thereto. Unless noted otherwise, all percentages are intended to be by weight. The abbreviations for some of the ingredients in the Examples were as follows:

| | |
|---|---|
| LAS | Alkylbenzene sulfonic acid |
| LES | Lauryl ether sulfate |
| Neodol ® 25-9 | 9-EO $C_{12-15}$ alcohol ethoxylate |
| Oleic Acid | Priolene 6905 |

Rheology Measurement

Each sample's shear thinning behavior was analyzed using a TA Instruments AR500N Rheometer. This is a controlled stress model and for each sample the torque range was adjusted (approximately 100 $\mu$N-m–500 $\mu$N-m) so that the resulting shear rates were in the 1 $s^{-1}$–100 $s^{-1}$ range. The temperature was controled at 25° C.

Shear rate versus viscosity curves were measured using the following conditions:

Pre-shear: 10 seconds at 50 $\mu$N-m shear and followed with 15 minute equilibration period.

Shear Rate Ramp: approximately 100 $\mu$N-m–500 $\mu$N-m shear stress @ 25° C. Or about 0.1$s^{-1}$ to 100.0 $s^{-1}$ shear rate Each sample's shear rate versus viscosity curve will be fit to the Sisko model:

$$\eta = a + b \times \dot{\gamma}^{n-1}.$$

The pouring viscosity may be measured directly at 21 $s^{-1}$ of shear rate or may be obtained by the interpolation of rheological data.

Measurement of the Yield Stress

The viscometer was set at its minimum speed (0.1 RPM) and the amount of stress was measured as a percentage of the spring torque (% torque) until its maximum $T_{max}$ was reached. This maximum % torque value can be converted into yield stress, $\tau_y$ based on the vane geometry as shown in the following equation:

$$\tau_y = \frac{T_{\max} \times C_s}{\frac{\pi D_{vane}^3}{2} \times \left(\frac{H_{vane}}{D_{vane}} + \frac{1}{3}\right)}$$

where Vane Height, $H_{Vane}$=0.011 76 m

Vane Diameter, $D_{Vane}$=0.00589 m

Cs, Spring constant.

To calculate the minimum required yield stress for suspending capsules, the largest particle size 1600 microns and lowest density of 850 kg/$m^3$ were used. The density of gels in Examples 1 and 2 are 1070 kg/$m^3$. Thus the minimum yield stress for gel has to be greater than 3.61 Pa, which is less than the actual yield stress of both examples.

EXAMPLES 1 AND 2

The Examples (both within the scope of the invention) were prepared by first preparing a main mix by mixing water, propylene glycol, Borax, 70% sorbitol solution, 50% sodium hydroxide solution, boric acid, citrate, monoethanolamine, and 70% active LES. After LES was dissolved under moderate agitation, sulfonic acid was added to the main mix.

Mixing was continued until both acids were fully dispersed and neutralized or the full consumption of alkaline neutralizing agents. Pre-mix was then prepared by mixing nonionic surfactant and oleic acid. Subsequently, the pre-mix was added into the main mix with agitation. The capsules were added last with gentle agitation, after the gel was formed. The particle size of these beads ranged from 500 to 1600 microns.

The Examples resulted in the formation of a gel with stably suspended capsules. After one year of room temperature, 25° C., storage, the capsules were still visible from the glass storage jar and did not show any sign of segregation. The results that were obtained are summarized in Table 1.

TABLE 1

| Component | Example No. 1 | Example No. 2 |
|---|---|---|
| DI Water | 40.91 | 40.91 |
| Sorbitol, 70% | 7.90 | 7.90 |
| Borax | 2.30 | 2.30 |
| Sodium Citrate | 3.00 | 3.00 |
| Propylene Glycol | 6.60 | 6.60 |
| Boric acid | | |
| NaOH, 50% | | |
| LES, 70% | 11.43 | 11.43 |
| NaOH, 50% | 2.02 | 1.96 |
| Monoethanol amine | 0.81 | 0.79 |
| LAS acid | 8.38 | 8.16 |
| Neodol ® 25-9 | 8.00 | 7.80 |
| Oleic Acid | 8.00 | 7.80 |
| Shea Butter capsules (500–1600 micron size beads) | 1.00 | 1.00 |
| Miscellaneous | To 100 | To 100 |
| Degree of FA Neutralization, % | 45 | 45 |
| pH | 6.85 | 6.85 |
| % Surfactant; A | 29.38 | 28.83 |
| % Fatty Acid | | |
| Added | 8.00 | 7.80 |
| Non-neutralized % | 4.40 | 4.30 |
| Weight % ratio of Non-neutralized Fatty Acid to Surfactant | 0.15 | 0.15 |
| Gelling Index, G | 0.07 | 0.07 |
| Pouring viscosity, cP | 1,620 | 1,260 |
| Yield stress, Pa | 4.59 | 4.59 |
| Sisko Rate Index | 0.407 | 0.244 |

COMPARATIVE EXAMPLES A AND B

Examples A and B (both outside the scope of the invention) were prepared by following the procedure described in Examples 1–2. The results that were obtained are summarized in Table 2.

TABLE 2

| Ingredients | % by weight of the composition Example No. A | % by weight of the composition Example No. B |
|---|---|---|
| Linear Alkyl Benzene Sulfonic acid | 4.77 | 3.82 |
| Non-ionic (C12–C14, 9 EO) | 5.5 | 4 |
| Oleic Fatty Acid | 2 | 4 |
| Coconut Fatty Acid | 3 | 8 |

TABLE 2-continued

| Ingredients | % by weight of the composition Example No. A | % by weight of the composition Example No. B |
|---|---|---|
| Sorbitol (70% active) | 7.9 | 7.9 |
| Borax | 2.3 | 2.3 |
| NaOH (50% active) | 1.1 | 1 |
| Monoethanolamine | 0.8 | 0.3 |
| Propylene Glycol | 2 | 0 |
| Water and Miscellaneous | To 100 | To 100 |
| Degree of FA Neutralization, % | 50 | 10 |
| pH | 7.1 | 5.9 |
| % Surfactant; A | 13.77 | 9.61 |
| % Fatty Acid | | |
| Added | 5 | 12 |
| Non-neutralized | 2.50 | 10.80 |
| Weight % ratio of Non-neutralized Fatty Acid to Surfactant | 0.18 | 1.12 |
| Gelling Index, G | 0.19 | 0.48 |

The weight % ratio of total non-neutralized fatty acid to total surfactant was lower than Gelling Index G in Example A, therefore, it was not a stable gel. In Example B the weight % ratio of total non-neutralized fatty acid to total surfactant was more than 1—Example B was phase separated in 24 hours. Neither example was capable of suspending any particles, since it did not form a gel.

What is claimed is:

1. A gel laundry detergent and/or pre-treater composition comprising:

(a) from about 8% to about 35%, by weight of the composition, of a surfactant, A, selected from the group consisting of anionic, nonionic and cationic, and amphoteric surfactants and mixtures thereof;

(b) from about 0.1% to about 5%, by weight of the composition of a non-neutralized fatty acid;

(c) from about 50 to about 90% of water;

(d) additional laundry composition ingredient selected from enzyme, builder, fluorescent dye, soil-release polymer, buffering agent, and mxitures thereof;

(e) from about 0.1% to about 10%, by weight of the composition of suspended particles having a size from about 300 to about 5000 microns;

(f) wherein the weight % ratio of the structuring agent to the surfactant is less than about 1 but greater than or equal to the Gelling Index Value, G, defined by equation (I)

$$G = \frac{0.75}{1 + (0.11 \times A)^{8.3}} - (0.0062 \times A - 0.25). \quad \text{(I)}$$

2. The composition of claim 1 wherein the particles in the composition are suspended or dispersed without any sedimentation.

3. The composition of claim 1 wherein the yield stress of the composition is in the range of from about 0.01 Pa to about 10 kPa.

4. The composition of claim 1, wherein the $P_y A_p \geqq (P_p - P_g) g V_p$ where $A_p$ is the surface area of a particle, $P_p$ is the density of particle, $P_g$ is the density of gel, g is the gravitational acceleration, $V_p$ is the volume of a particle.

5. The composition of claim 1 wherein the total surfactant amount is less than about 25%, by weight of the composition.

6. The composition of claim 1, wherein the composition is substantially free of conventional structuring agents.

7. The composition of claim 1, wherein the composition is transparent/translusent.

8. The composition of claim 1 wherein the composition is packaged in a transparent container.

9. The composition of claim 1 wherein the pH of the composition is within the range of from about 6 to about 8.

10. The composition of claim 1 wherein the surfactant comprises an anionic surfactant.

11. The composition of claim 9 wherein the anionic surfactant comprises a mixture of a synthetic anionic surfactant and soap.

12. The composition of claim 1 wherein the surfactant comprises a mixture of an anionic surfactant and a nonionic surfactant.

13. The composition of claim 11 wherein the non-neutralized fatty acid in the composition is an unsaturated fatty acid.

14. The composition of claim 12 wherein the composition comprises from about 0.01% to about 5.0%, by weight of the composition, of an antioxidant.

15. The composition of claim 1 wherein the composition further comprises a pH jump system.

* * * * *